US011799233B2

(12) United States Patent
Yoshida

(10) Patent No.: US 11,799,233 B2
(45) Date of Patent: Oct. 24, 2023

(54) CONNECTOR

(71) Applicant: SUMITOMO WIRING SYSTEMS, LTD., Mie (JP)

(72) Inventor: Yutaro Yoshida, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 91 days.

(21) Appl. No.: 17/477,767

(22) Filed: Sep. 17, 2021

(65) Prior Publication Data

US 2022/0102905 A1 Mar. 31, 2022

(30) Foreign Application Priority Data

Sep. 28, 2020 (JP) ..... 2020-161944

(51) Int. Cl.
*H01R 13/516* (2006.01)
*H01R 13/629* (2006.01)

(52) U.S. Cl.
CPC ..... *H01R 13/516* (2013.01); *H01R 13/62938* (2013.01)

(58) Field of Classification Search
CPC ..... H01R 13/516; H01R 13/62938; H01R 13/5808; H01R 13/5804; H01R 13/506
See application file for complete search history.

(56) References Cited

U.S. PATENT DOCUMENTS 7,150,640 B2 12/2006 Fukui et al.
7,234,952 B2 6/2007 Sasaki et al.
9,917,395 B2 3/2018 Yoshida
10,236,618 B1 * 3/2019 Irish ..... H01R 13/562
2006/0141850 A1 * 6/2006 Nishide ..... H01R 13/514 439/468
2011/0230106 A1 * 9/2011 Shamoto ..... H01R 13/506 439/892
2013/0280935 A1 * 10/2013 Shishikura ..... H01R 13/44 439/157
2014/0322942 A1 * 10/2014 Kuroda ..... H01R 13/56 439/157
2016/0352039 A1 * 12/2016 Yamaki ..... H01R 13/56
2020/0295505 A1 * 9/2020 Iida ..... H01R 13/562
2020/0381862 A1 * 12/2020 Kobayashi ..... H01R 13/62938
2021/0135388 A1 * 5/2021 Miyazawa ..... H01R 13/447

FOREIGN PATENT DOCUMENTS

JP 2014053167 * 3/2014 ..... H01R 13/506

* cited by examiner

*Primary Examiner* — Truc T Nguyen
(74) *Attorney, Agent, or Firm* — Venjuris, P.C.

(57) ABSTRACT

A housing 20 includes a plurality of engaging portions 27 arranged at positions point-symmetrical in a back view on a peripheral edge part of a rear surface and protrusions 22 arranged to project rearward from the rear surface. A cover 70 includes engaged portions 81 to 85 to be engaged with and held by the engaging portions 27, a space portion 77 in which the protrusions 22 are located with the cover 70 properly assembled with the housing 20, and an interfering portion for interfering with the protrusions 22 when the cover 70 is in a posture opposite to the proper one with respect to the housing 20.

9 Claims, 10 Drawing Sheets

CONNECTOR

CROSS-REFERENCE TO RELATED APPLICATIONS

This application is based on and claims priority from Japanese Patent Application No. 2020-161944, filed on Sep. 28, 2020, with the Japan Patent Office, the disclosure of which is incorporated herein in their entireties by reference.

TECHNICAL FIELD

The present disclosure relates to a connector.

BACKGROUND

A connector described in Japanese Patent Laid-open Publication No. 2006-294359 includes a housing (connector housing) and a cover to be assembled with the housing to cover the rear surface of the housing. The housing includes side walls paired in a height direction on a peripheral edge part of the rear surface, and a pair of engaging portions are provided on both sides in a width direction of each side wall. The cover includes a pair of locking projections at positions corresponding to each pair of the engaging portions. By engaging the respective locking projections and the respective engaging portions, the detachment of the cover from the housing is restricted. A connector with a housing and a cover is also disclosed in Japanese Patent Laid-open Publication Nos. 2007-115443 and 2017-142922.

SUMMARY

In the case of Japanese Patent Laid-open Publication No. 2006-294359, the respective engaging portions are arranged at positions point-symmetrical on each side wall when the housing is viewed from behind. Thus, even if the cover is inverted in the height direction from a state disclosed in Japanese Patent Laid-open Publication No. 2006-294359, the respective engaging portions and the respective locking projections can be engaged and the cover can be assembled with the housing. To provide the cover with reversibility in this way, a wire pull-out direction can be changed.

In contrast, a configuration for preventing erroneous assembly of a cover may be required by specifying a wire pull-out direction to one direction and losing the reversibility of the cover. However, there is a problem that the configuration disclosed in Japanese Patent Laid-open Publication No. 2006-294359 is compatible with a cover required to have reversibility, but is not compatible with a cover required to have certain assemblability to prevent erroneous assembly.

Accordingly, the present disclosure aims to provide a connector compatible also with a cover required to have certain assemblability to prevent erroneous assembly.

The present disclosure is directed to a connector with a housing, and a cover to be assembled with the housing to cover a rear surface of the housing, wherein the housing includes a plurality of engaging portions arranged at positions point-symmetrical in a back view on a peripheral edge part of the rear surface and a protrusion arranged to project rearward from the rear surface, and the cover includes engaged portions to be engaged with and held by the engaging portions, a space portion, the protrusion being located in the space portion with the cover properly assembled with the housing, and an interfering portion for interfering with the protrusion when the cover is in a posture opposite to the proper one with respect to the housing.

According to the present disclosure, it is possible to provide a connector compatible also with a cover required to have certain assemblability to prevent erroneous assembly.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
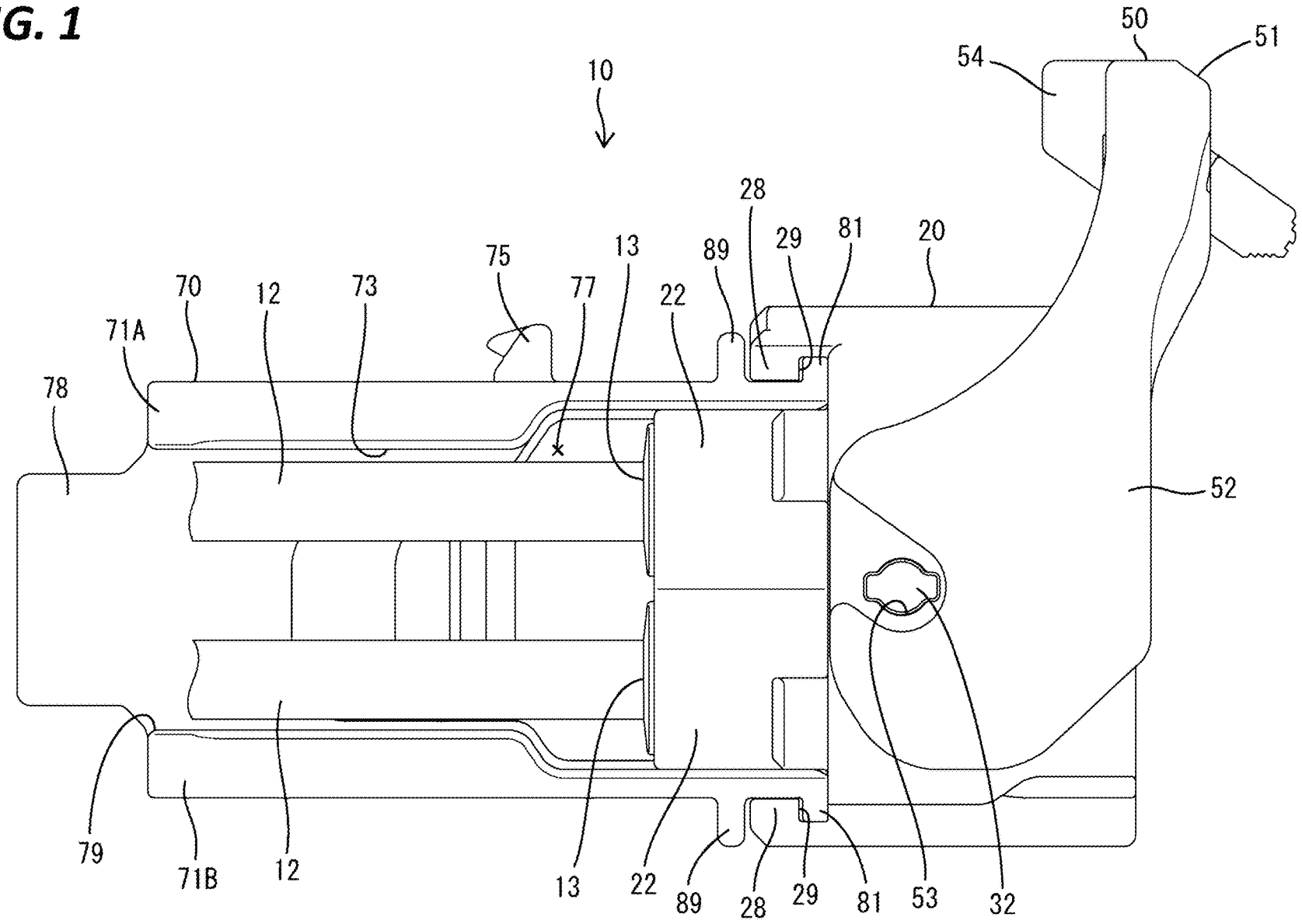
FIG. 1 is a side view of a connector of an embodiment viewed from an opening side of a cover.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure includes a housing, and a cover to be assembled with the housing to cover a rear surface of the housing, wherein the housing includes a plurality of engaging portions arranged at positions point-symmetrical in a back view on a peripheral edge part of the rear surface and a protrusion arranged to project rearward from the rear surface, and the cover includes engaged portions to be engaged with and held by the engaging portions, a space portion, the protrusion being located in the space portion with the cover properly assembled with the housing, and an interfering portion for interfering with the protrusion when the cover is in a posture opposite to the proper one with respect to the housing.

According to the above configuration, the cover is properly assembled with the housing with the engaged portions of the cover engaged with the respective engaging portions of the housing and the protrusion located in the space portion. In contrast, if the cover is in the posture opposite to the proper one, the interfering portion interferes with the protrusion and an assembling operation of the cover is restricted. In this way, the cover can realize a state where the cover is assembled in a certain posture by including the space portion and the interfering portion, and erroneous assembly of the cover with the housing can be prevented.

On the other hand, for example, a cover including no interfering portion can avoid interference with the protrusion and the engaged portions can be engaged with the engaging portions arranged at the positions point-symmetrical in the back view. Thus, the cover can be assembled with the housing without being vertically distinguished in a height direction. Therefore, the connector having the above configuration is compatible with both a cover required to have certain assemblability to prevent erroneous assembly and a cover required to have reversibility.

(2) Preferably, the housing includes a cavity capable of accommodating a terminal fitting, and the protrusion is tubular to surround the cavity. According to this configuration, the protrusion can have a function of preventing erroneous assembly of the cover and a function of forming the cavity, and the complication of the structure of the housing can be avoided.

(3) The cover may be cap-shaped and include a pair of facing walls facing each other in the height direction and a back wall for closing a space between rear end parts of the pair of facing walls, the facing wall may include a rib extending in a front-rear direction on an inner surface, and the interfering portion may be constituted by the rib. According to this configuration, the interfering portion can have the function of preventing erroneous assembly of the cover and a function of reinforcing the cover, and the complication of the structure of the cover can be avoided.

(4) The cover may include an opening open laterally on one end part in a width direction of the cover and an end wall for closing another end part in the width direction, and the rib may be provided between a central part in the width direction and the end wall on the inner surface of the facing wall. According to this configuration, the rib is provided at a position near the end wall, wherefore the opening deformation of the respective facing walls can be effectively suppressed.

(5) A projection dimension of the rib from the inner surface of the facing wall may be smaller than a radial thickness of the tubular protrusion. According to this configuration, when the cover is in the opposite posture, an end part of the rib can interfere with the protrusion in a thickness range of the protrusion. Thus, the interference of the rib with a wire, a rubber plug and the like projecting from the cavity of the protrusion can be avoided. As a result, the damage of the wire, the rubber plug and the like can be suppressed.

(6) A front end of the rib may be arranged behind a front end of the facing wall. According to this configuration, when the cover is in the opposite posture, the protrusion can interfere with the rib from a state where the protrusion is inserted between the pair of facing walls. As a result, the rib and the protrusion can be arranged at such relative positions to be interferable with each other before the rib interferes with the protrusion. As a result, when the cover is in the opposite posture, a state where the rib interferes with the protrusion can be realized with good reliability.

Details of Embodiment of Present Disclosure

A specific example of an embodiment of the present disclosure is described below with reference to the drawings. Note that the present invention is not limited to these illustrations and is intended to be represented by claims and include all changes in the scope of claims and in the meaning and scope of equivalents.

Figure 2:
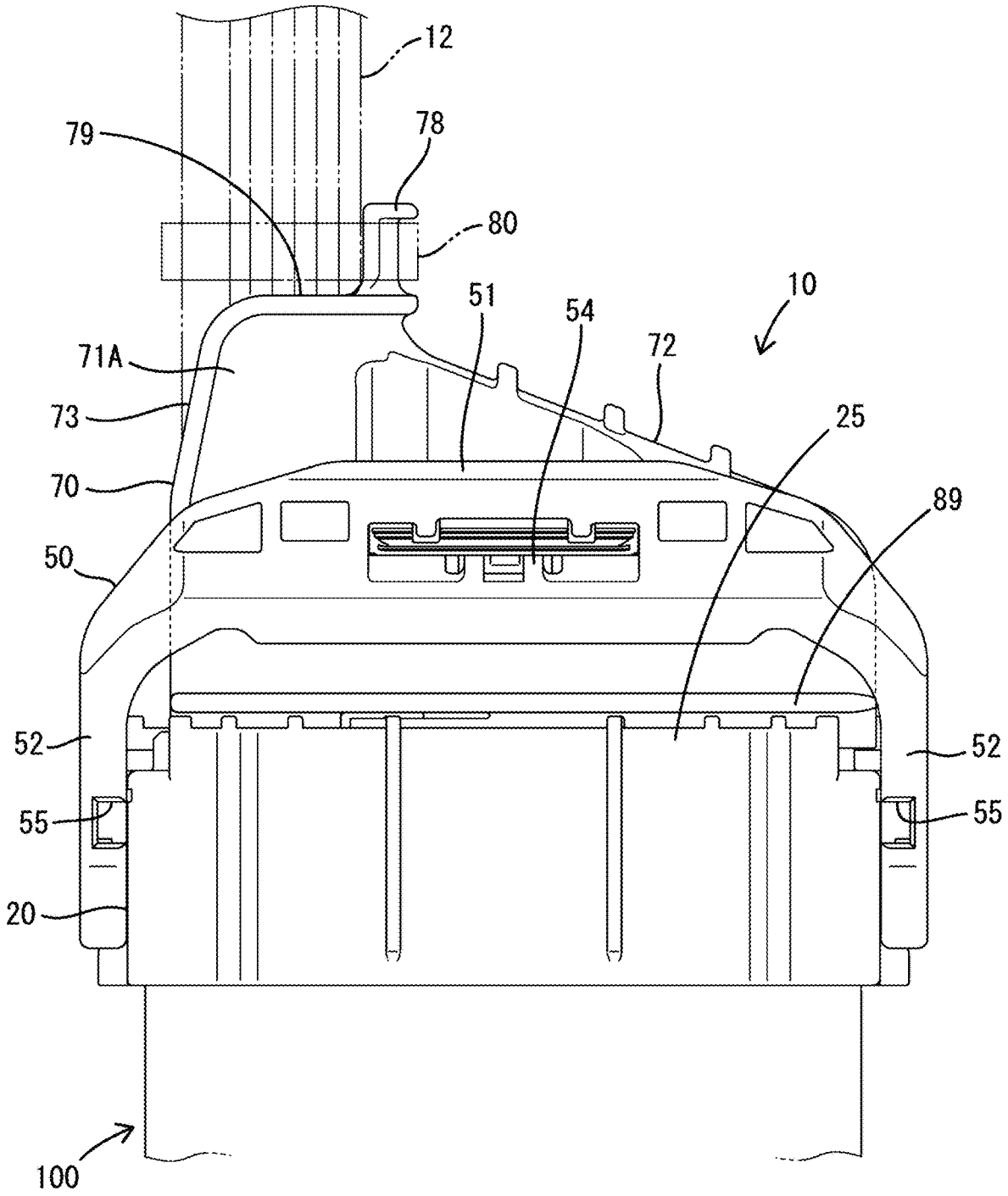
FIG. 2 is a plan view of the connector connected to a mating connector.

As shown in FIGS. 1 and 2, a connector 10 of this embodiment includes a housing 20, a lever 50 rotatably supported on the housing 20 and a cover 70 assembled with the housing 20. As shown in FIG. 2, the housing 20 is connectable to a mating connector 100. Note that, in the following description, a surface side of the housing 20 facing the mating connector 100 at the start of connection is referred to as a front side concerning a front-rear direction. Specifically, a right side of FIG. 1 is a front side. A height direction is synonymous with a vertical direction and based on a vertical direction in figures except FIGS. 2 and 8. A width direction is synonymous with a lateral direction and based on a lateral direction in figures except FIG. 1.

(Housing)

Figure 6:
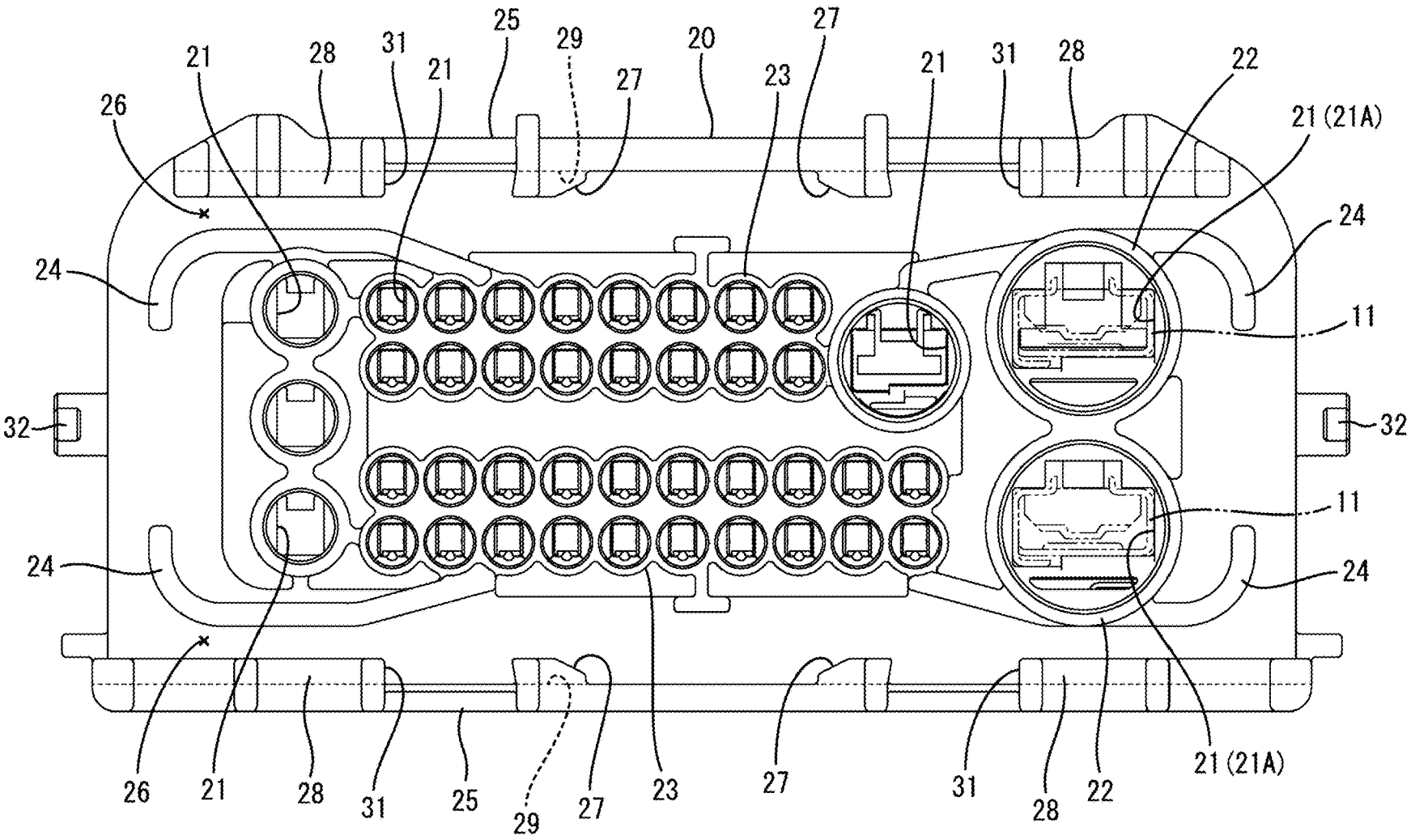
FIG. 6 is a back view of the housing.

The housing 20 is made of synthetic resin and in the form of a rectangular block and has, as shown in FIG. 6, a rectangular shape long in the width direction in a back view. The housing 20 includes a plurality of cavities 21 penetrating in the front-rear direction. The respective cavities 21 are aligned and arranged in the height and width directions in the housing 20. Out of the respective cavities 21, two cavities 21 arranged on one end side (right end side of FIG. 6) in the width direction of the housing 20 are configured as large-diameter cavities 21A having a particularly large opening diameter than the other cavities 21.

Figure 3:
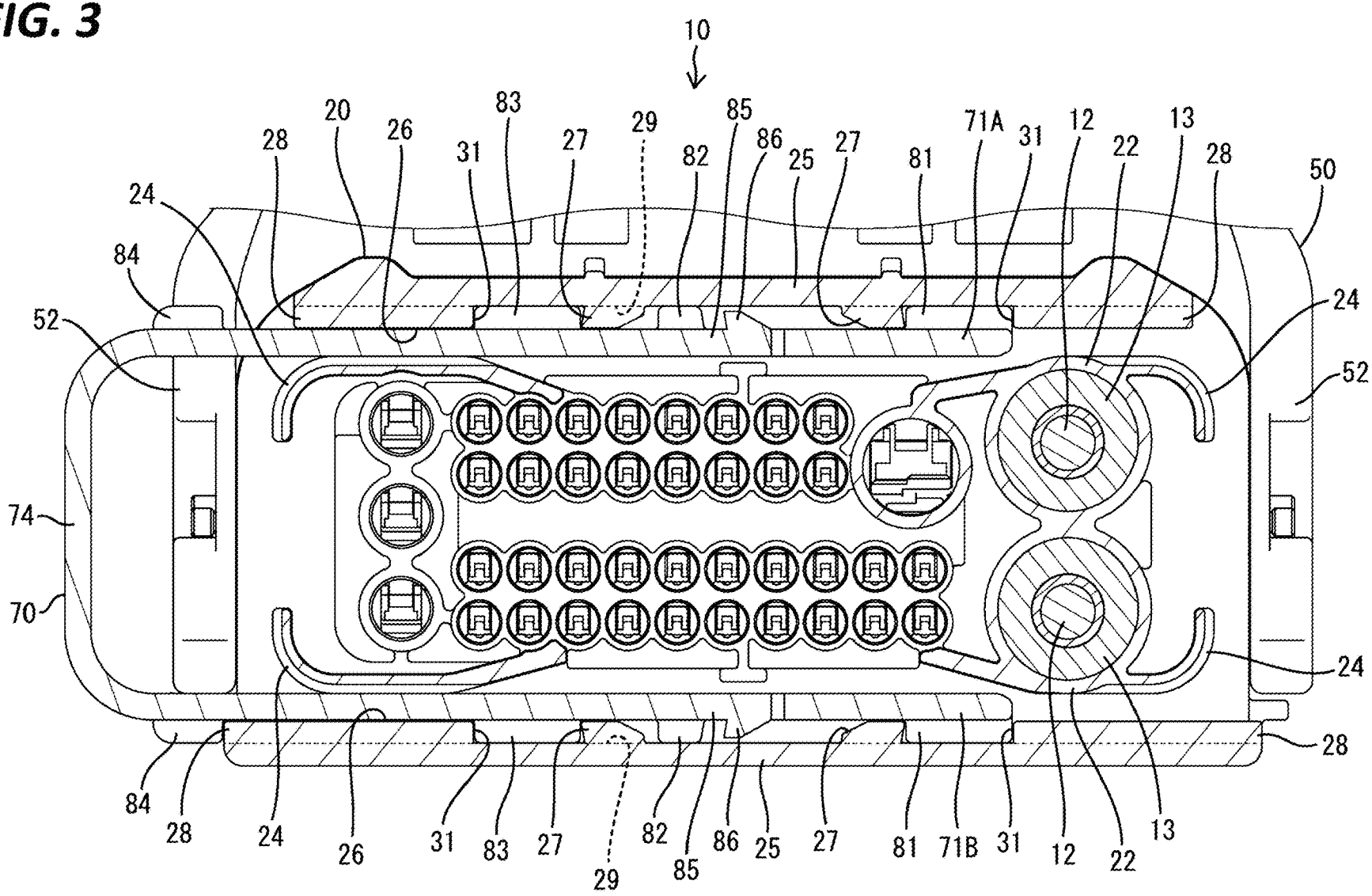
FIG. 3 is a section showing a state where the cover is set at an initial position with respect to a housing.
Figure 4:
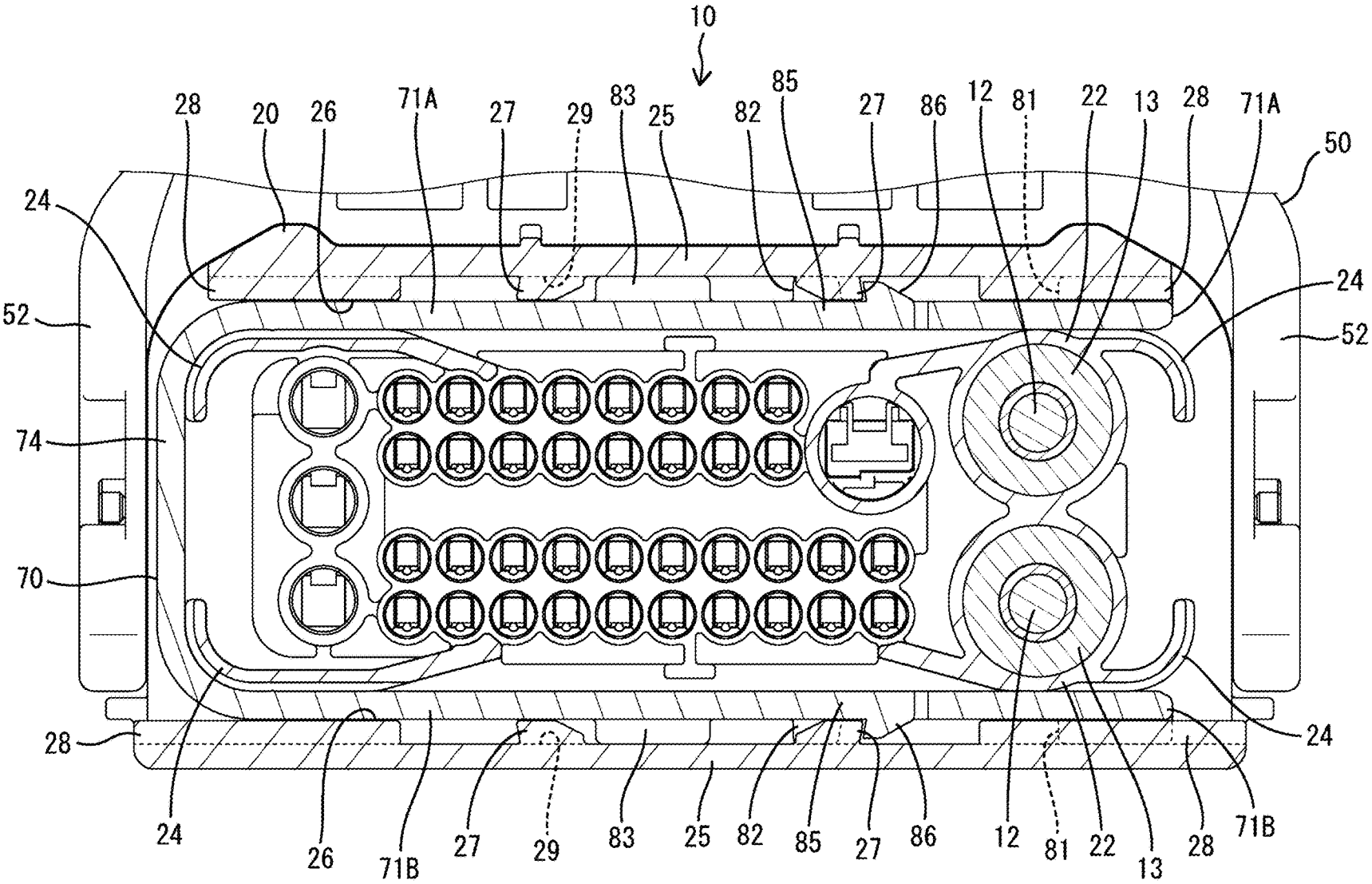
FIG. 4 is a section showing a state where the cover is assembled at an assembly end position with respect to the housing.
Figure 5:
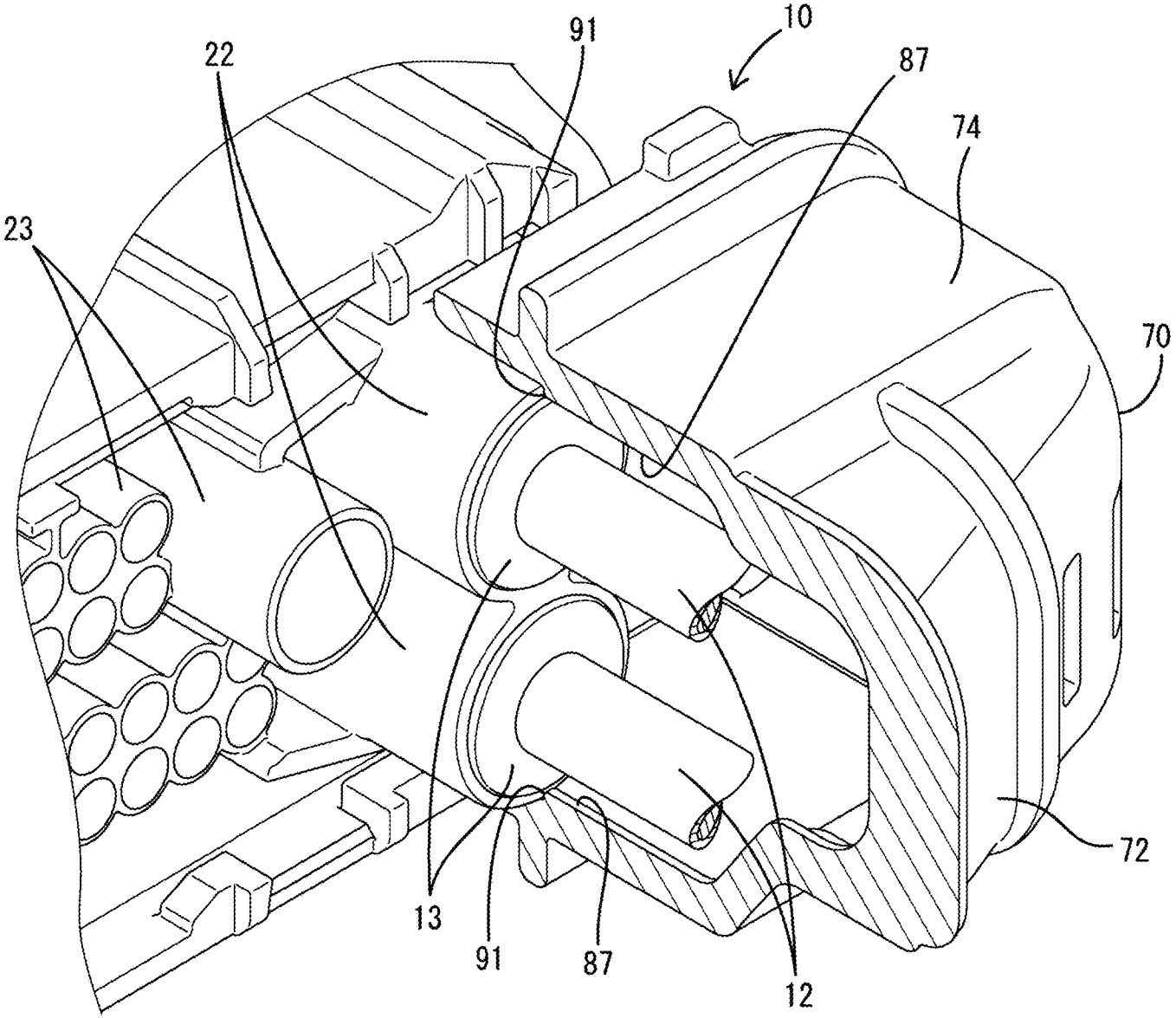
FIG. 5 is a perspective view partly in section showing a state where the assembly of the cover with the housing is restricted when the cover is in a posture opposite to the proper one with respect to the housing.

Terminal fittings 11 made of metal are inserted and accommodated into the respective cavities 21 of the housing as shown in FIG. 6. The terminal fitting 11 is connected to an end part of a wire 12. As shown in FIGS. 3 to 5, a rubber plug 13 made of rubber is fit to the wire 12.

The housing 20 includes a pair of protrusions 22 projecting rearward from the one end side in the width direction of the rear surface. The respective protrusions 22 have a hollow cylindrical shape and are arranged in the height direction. The lower end of the upper protrusion 22 and the upper end of the lower protrusion 22 are coupled to each other. Each protrusion 22 surrounds a rear part of the large-diameter cavity 21A. As shown in FIG. 5, the rear end (opening end and a rearward facing end surface 33 to be described later) of each protrusion 22 is located at the rearmost end of the housing 20. Note that rear parts of the other cavities 21 are surrounded by tubular portions 23 having a smaller diameter and a smaller projection dimension than each protrusion 22. The rubber plug 13 is inserted into a rear part of the large-diameter cavity 21A. The rubber plug 13 is held in close contact with the inner peripheral surface of each protrusion 22. The wire 12 is pulled out rearward from the rear end of each protrusion 22.

As shown in FIG. 6, the housing 20 includes corner wall portions 24 projecting rearward from end parts on four corner sides on the rear surface. Each corner wall portion 24 is shaped to extend in a curved manner in the back view to extend along the corresponding corner. On one end side in the width direction of the housing 20, the upper corner wall portion 24 is coupled to the upper end of the upper protrusion 22 and the lower corner wall portion 24 is coupled to the lower end of the lower protrusion 22.

The housing 20 includes a pair of plate wall portions 25 on upper and lower end parts across the rear surface. Each plate wall portion 25 is in the form of a plate along the width direction of the housing 20, and a fitting space 26, into which the cover 70 is mountable, is formed between the plate wall portion 25 and each protrusion 22 and each corner wall portion 24.

As shown in FIG. 6, engaging portions 27 trapezoidal in the back view are provided to project on the inner surfaces of the respective plate wall portions 25 (lower surface of the upper plate wall portion 25 and upper surface of the lower plate wall portion 25). The respective engaging portions 27 are arranged at symmetrical positions on both sides across a widthwise center in a rear end part of each plate wall portion 25. Particularly, the upper and lower engaging portions 27 are arranged at point-symmetrical positions with respect to a center of the rear surface of the housing 20 in the back view.

Outer engaging portions 28 rectangular in the back view are provided to project on end parts outward of the respective engaging portions 27 in the width direction on the inner surface of each plate wall portion 25. The respective outer engaging portions 28 are arranged at symmetrical positions on both sides across the widthwise center in the rear end part of each plate wall portion 25. Particularly, the upper and lower outer engaging portions 28 are arranged at point-symmetrical positions with respect to the center of the rear surface of the housing 20 in the back view.

The housing 20 includes passages 29 extending in the width direction in front of the respective engaging portions 27 and the respective outer engaging portions 28. Further, the housing 20 includes receiving ports 31 open rearward between each engaging portion 27 and each outer engaging portion 28. Later-described retaining portions 81 to 84 of the cover 70 are inserted into the passages 29 through the receiving ports 31 when the cover 70 is assembled (see FIG. 3).

As shown in FIG. 6, the housing 20 includes a pair of shaft portions 32 on end surfaces on both widthwise sides. Each shaft portion 32 has a cylindrical shape and serves as a part for rotatably supporting the lever 50.

(Lever)

The lever 50 is made of synthetic resin and includes, as shown in FIG. 2, an operating portion 51 extending long in the width direction and a pair of side plate portions 52 projecting from both widthwise end parts of the operating portion 51 while facing each other. As shown in FIG. 1, each side plate portion 52 includes a bearing hole 53. The lever 50 is rotatable about the respective shaft portions 32 with the respective shaft portions 32 fit in the respective bearing holes 53. A worker can rotate the lever 50 by gripping the operating portion 51. As shown in FIG. 2, each side plate portion 52 is formed with a cam groove 55. The cam groove 55 of each side plate portion 52 is engaged with an unillustrated cam follower of the mating connector 100 and the lever 50 is rotated, whereby the both connectors 10, 100 are connected to each other. The operating portion 51 includes, in a widthwise central part, a lever-side lock portion 54 to be locked to the cover 70 when the both connectors 10, 100 are connected.

(Cover)

Figure 7:
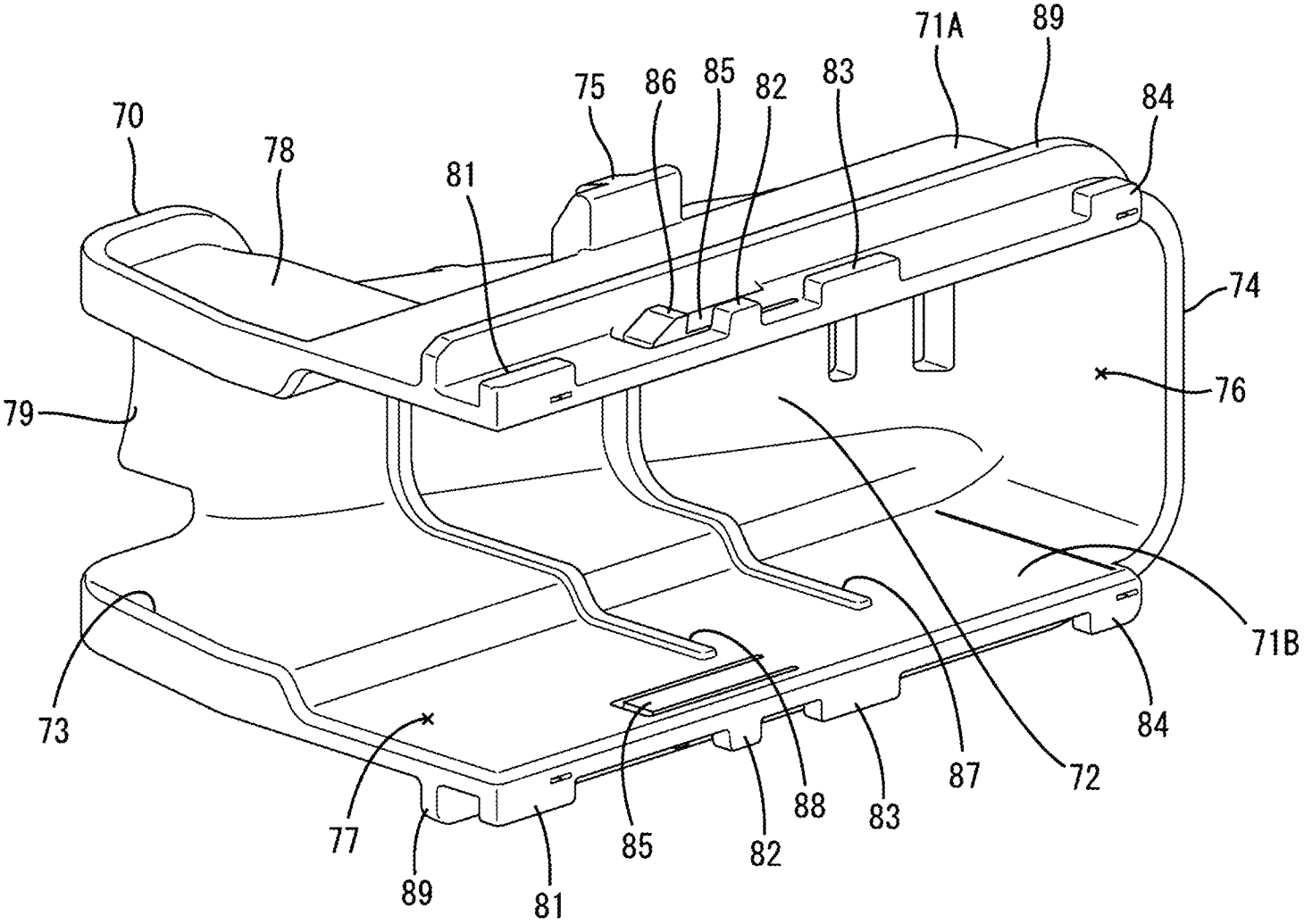
FIG. 7 is a perspective view of the cover viewed from an upper side.
Figure 8:
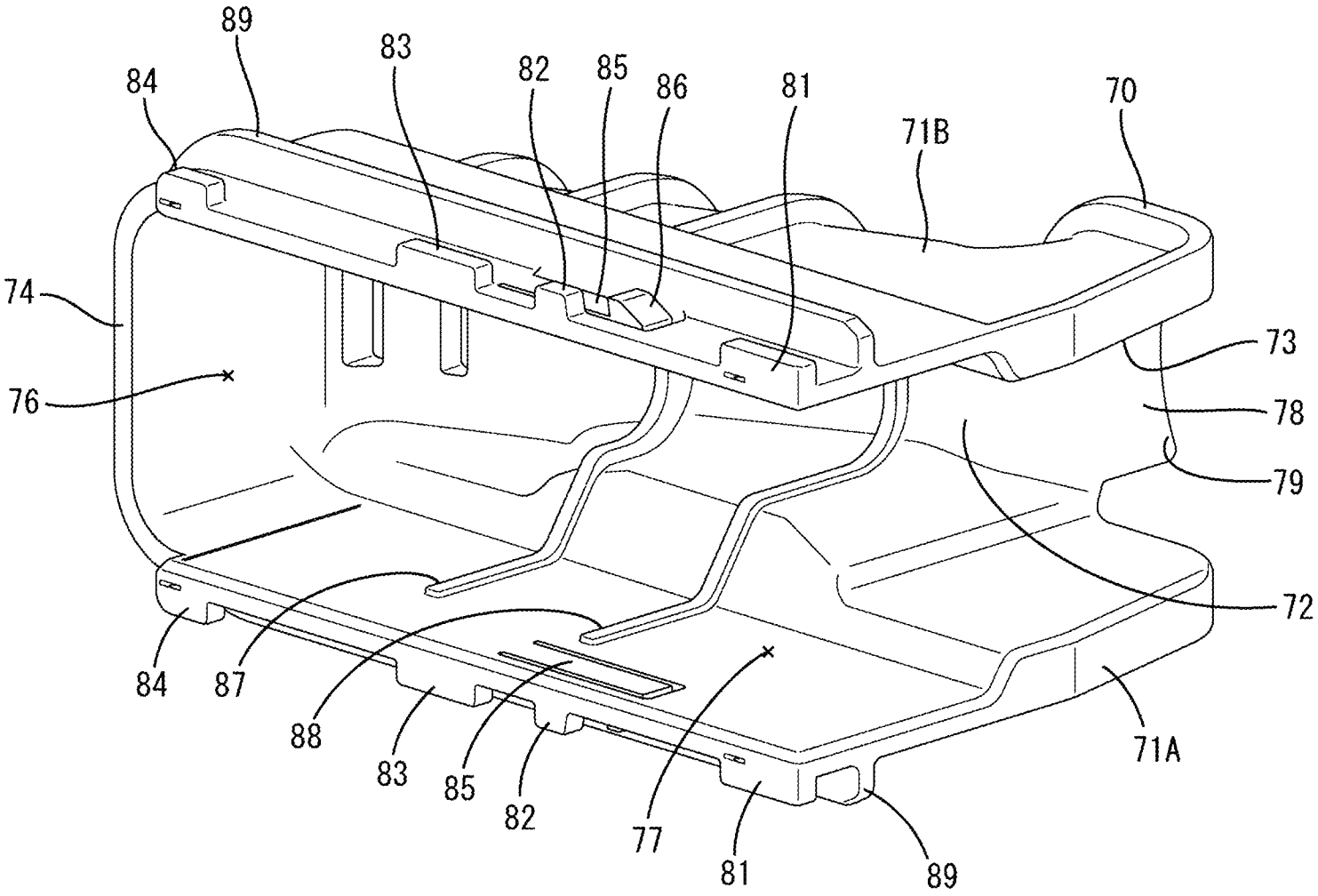
FIG. 8 is a perspective view of the cover viewed from a lower side.
Figure 9:
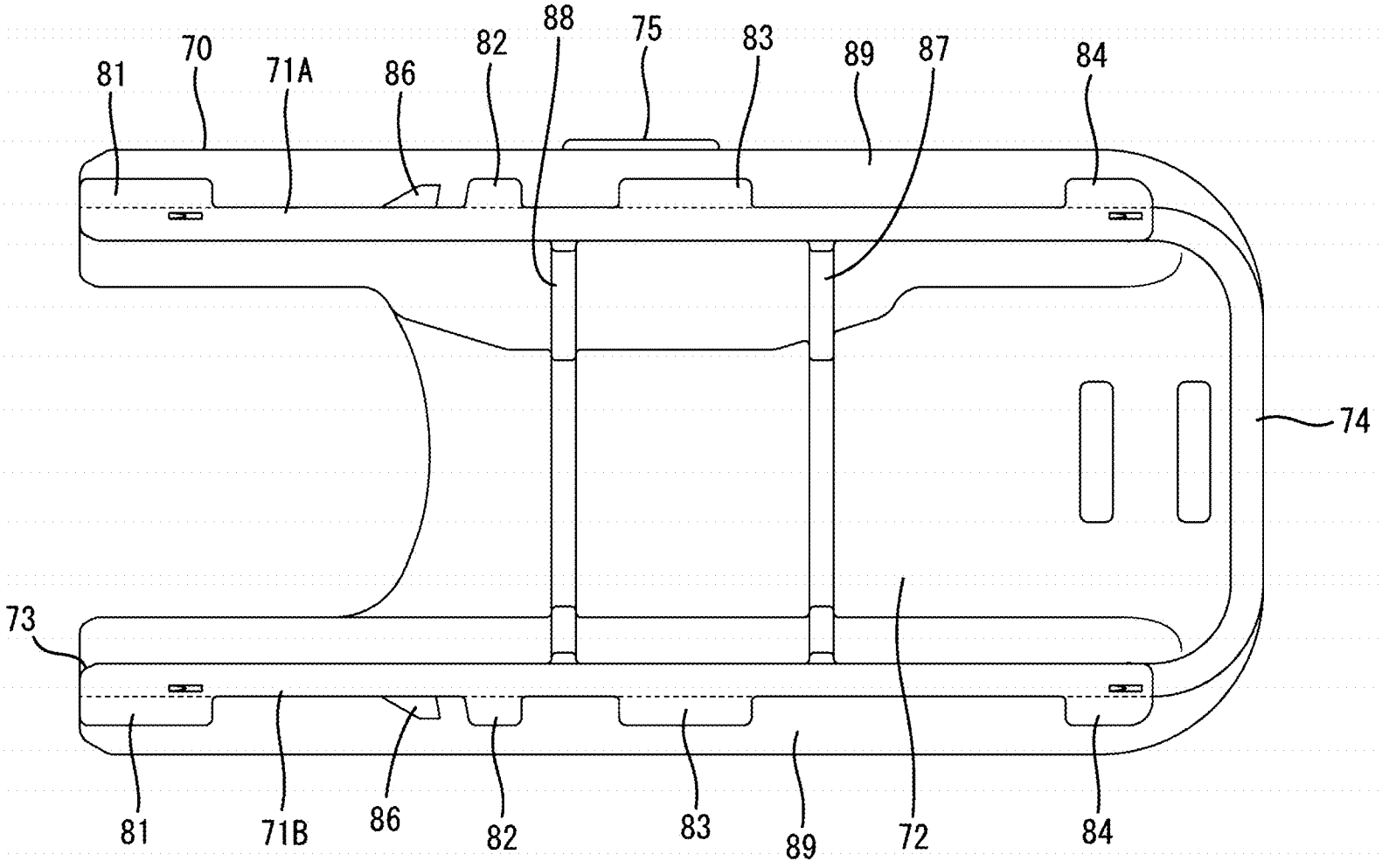
FIG. 9 is a front view of the cover.

The cover 70 is made of synthetic resin and, as shown in FIGS. 7 to 9, in the form of a cap open forward. The cover 70 is assembled with the housing 20 to cover the rear surface of the housing 20. Specifically, the cover 70 includes a pair of facing walls 71A, 71B arranged to vertically face each other in the height direction, a back wall 72 arranged to close a space between rear end parts of the respective facing walls 71A, 71B, an opening 73 open laterally in one widthwise end part of the cover 70, and an end wall 74 arranged to close the other widthwise end part of the cover 70 on this other end part. As shown in FIGS. 3 and 4, out of the pair of facing walls 71A, 71B, the upper facing wall 71A is mounted on an upper surface side of the housing 20, and the lower facing wall 71B is mounted on a lower surface side of the housing 20. As shown in FIG. 7, a cover-side lock portion 75 lockable to the lever-side lock portion 54 is provided to project on the upper surface (outer surface) of the upper facing wall 71A. Note that the cover-side lock portion 75 is not provided on the lower facing wall 71B.

A front part of the inside of the cover 70 serves as an interval enlarging portion 76 having a larger widthwise interval between the inner surfaces of the respective facing walls 71A, 71B (lower surface of the upper facing wall 71A and upper surface of the lower facing wall 71B) than in a rear part. The interval enlarging portion 76 of the cover 70 includes a space portion 77, in which the respective protrusions 22 are arranged to be fittable, between a second rib 88 to be described later and the opening 73 as shown in FIG. 1.

Further, as shown in FIG. 2, the cover 70 includes a projecting wall portion 78 projecting rearward from the back wall 72 on one widthwise end part, and a wire draw-out opening 79 communicating with the opening 73 and open rearward. The wire draw-out opening 79 is partitioned by the projecting wall portion 78. The respective wires 12 extending from the respective tubular portions 23 and the respective protrusions 22 of the housing 20 are bent in the cover 70 and collected in the wire draw-out opening 79. The respective wires 12 are fixed to the projecting wall portion 78 by a binding band 80 such as a tie band and, in that state, drawn out rearwardly of the cover 70.

As shown in FIGS. 7 and 8, each facing wall 71A, 71B includes engaged portions 81 to 85 engageable with the respective engaging portions 27 of the housing 20. The engaged portions 81 to 85 include a plurality of retaining portions 81 to 84 projecting from the outer surface (upper surface of the upper facing wall 71A, lower surface of the lower facing wall 71B) of a front end part of each facing wall 71A, 71B and rectangular in a front view. The respective retaining portions 81 to 84 include a first retaining portion 81, a second retaining portion 82, a third retaining portion 83 and a fourth retaining portion 84 successively arranged at intervals from one end side (side of the opening 73) to the other end side in the width direction on the end edge of the front end part of each facing wall 71A, 71B.

Further, the engaged portions 81 to 85 include a pair of locking portions 85 on a widthwise central side of the front end parts of the respective facing walls 71A, 71B. Each locking portion 85 is formed to be deflectable and deformable between cuts formed in each facing wall 71A, 71B behind (back side in FIG. 7) each second retaining portion 72. Each locking portion 85 is cantilevered toward one end side in the width direction and includes a claw-like locking projection 86 projecting outward on a tip part in an extending direction. As shown in FIG. 4, the locking projection 86 of each locking portion 85 is lockable to an end surface on one widthwise end side of each engaging portion 27.

Further, as shown in FIGS. 7 and 8, a ridge portion 89 extending in the width direction is provided behind the locking portion 85 on the outer surface of each facing wall 71A, 71B. When the cover 70 is assembled with the housing 20, the respective engaging portions 27 (see FIG. 3) and the respective outer engaging portions 28 (see FIG. 1) are arranged to be sandwiched between the ridge portions 89 and the respective retaining portions 81 to 84.

As shown in FIGS. 7 to 9, a rib 87 and the second rib 88 continuously extending from the respective facing walls 71A, 71B to the back wall 72 are provided to project on the inner surface of the cover 70. The rib 87 and the second rib 88 are arranged in parallel to each other. The rib 87 is arranged between the second rib 88 and the end wall 74 in the width direction.

Projection dimensions of the rib 87 and the second rib 88 are set to be smaller than a radial thickness of each protrusion 22. As shown in FIGS. 7 and 8, the front ends (both ends in the extending direction) of the respective rib 87 and second rib 88 are located behind (on the back side) the end edges of the respective facing walls 71A, 71B. The front ends of the second rib 88 are adjacent to the respective locking portions 85 and located behind (on the back side) the respective locking portions 85. The rib 87 is configured as an interfering portion configured to interfere with the respective protrusions 22 when the cover 70 is in a posture opposite to the proper one as described later.

(Assembling Structure of Cover with Housing)

In a state where the cover 70 is not assembled with the housing 20, each terminal fitting 11 is inserted into each cavity 21 of the housing 20 from behind. The wires 12 connected to the respective terminal fittings 11 are arranged to extend rearward from the rear ends of the respective protrusions 22 and tubular portions 23. Further, the respective rubber plugs 13 are fit into the respective protrusions 22 and the respective tubular portions 23. Sealing is provided in a liquid-tight manner between the respective protrusions 22 and tubular portions 23 and the respective wires 12 by the respective rubber plugs 13. As shown in FIG. 5, a rear end part of each rubber plug 13 is partially exposed rearward from the rear end of each protrusion 22.

Subsequently, the cover 70 is put on the housing 20 from behind and, as shown in FIG. 3, set at an initial position. At the initial position, the respective facing walls 71A, 71B are inserted in the fitting spaces 26 and the first and third retaining portions 81, 83 are inserted in the passages 29 through the receiving ports 31 and the second retaining portions 82 and the locking projections 86 are inserted into the passages 29 through between the respective engaging portions 27. Further, the fourth retaining portions 84 are arranged to be able to enter the passages 29 on a lateral side of the housing 20.

Subsequently, the cover 70 is pushed toward the one widthwise side (right side of FIG. 3) of the housing 20 and moved from the initial position to an assembling end position. Immediately before the cover 70 reaches the assembly end position, the locking projections 86 interfere with the engaging portions 27 on the right side of FIG. 3 to deflect and deform the locking portions 85. When the cover 70 reaches the assembly end position, the locking portions 85 resiliently return and, as shown in FIG. 4, the locking projections 86 are arranged to be lockable to the end surfaces of the engaging portions 27. In this way, a movement of the cover 70 with respect to the housing 20 in a return direction to the initial position is restricted. Further, when the cover 70 reaches the assembly end position, the first and fourth retaining portions 81, 84 are arranged to face the outer engaging portions 28 from front and the second retaining portions 82 are arranged to face the engaging portions 27 from front. In this way, a movement of the cover 70 in a direction to be detached rearward with respect to the housing 20 is restricted.

As shown in FIG. 1, when the cover 70 is at the assembly end position, the respective protrusions 22 are inserted over the entire height into the space portion 77 of the cover 70. The respective protrusions 22 are arranged to be able to contact the inner surfaces of the respective facing walls 71A, 71B in the space portion 77. The respective rubber plugs 13 exposed from the rear ends of the respective protrusions 22 and the respective wires 12 extending from the rear ends of the respective protrusions 22 can be visually confirmed through the opening 73 of the cover 70 from a lateral side.

In connection to the mating connector 100, the housing 20 is first lightly connected to the mating connector 100. Subsequently, the lever 50 is rotated and the operating portion 51 is displaced from an upper-front side to an upper-rear side of the housing 20 (see FIGS. 1 and 2). Thereafter, the lever-side lock portion 54 is locked to the cover-side lock portion 75 and the both connectors 10, 100 are held in a connected state. As shown in FIG. 2, the respective wires 12 are drawn out rearward from the one widthwise end side of the housing 20 through the wire draw-out opening 79 of the cover 70.

In contrast, if an attempt is made to assemble the cover 70 in a posture opposite to the above posture in the height direction with the housing 20, the opening 73 is facing the other widthwise end side (right side of FIG. 2), but the first and third retaining portions 81, 83 are arranged to be insertable into the receiving ports 31. If an assembling operation of the cover 70 progresses in that state, the respective protrusions 22 are inserted into the cover 70 along the inner surfaces of the respective facing walls 71A, 71B. Here, the respective protrusions 22 are arranged to face the rib 87 from front. Thus, if the assembling operation of the cover 70 progresses, the rear ends (rearward facing end surfaces 33 shown in FIG. 10) of the respective protrusions 22 butt against the front ends (forward facing end surfaces 91 shown in FIG. 5) of the rib 87 as shown in FIGS. 5 and 10, whereby any further assembling operation of the cover 70 is restricted.

Figure 10:
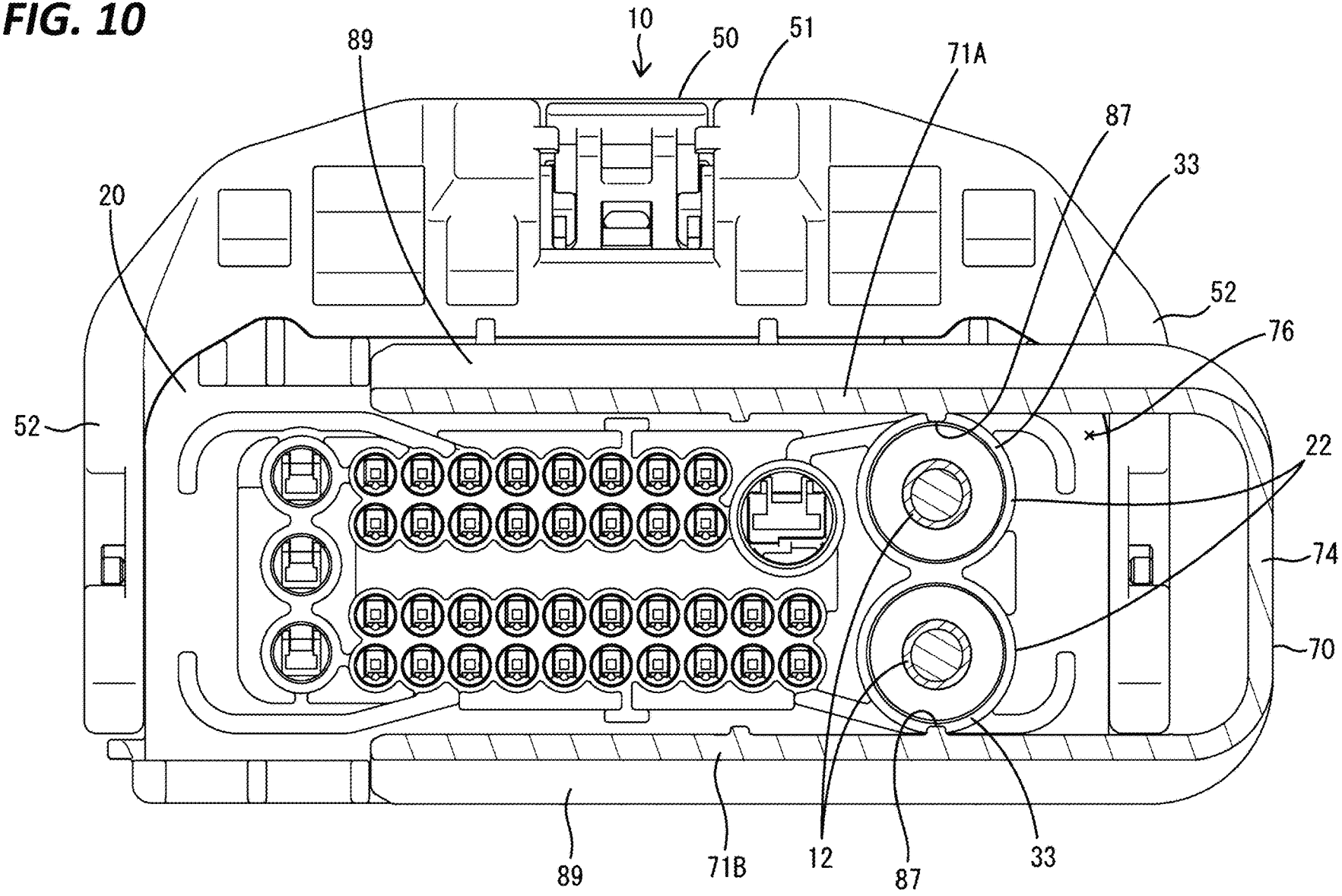
FIG. 10 is a front view partly in section showing the state where the assembly of the cover with the housing is restricted when the cover is in the posture opposite to the proper one with respect to the housing.

As shown in FIG. 10, a vertical dimension of the interval enlarging portion 76 of the cover 70 is equal to a vertical dimension of the respective protrusions 22 or close to this vertical dimension (with a dimensional difference in a thickness range of the rib 87 and the protrusions 22). Thus, a state where the respective protrusions 22 and the rib 87 interfere can be reliably realized from a state where the respective protrusions 22 are fit in the entrance of the interval enlarging portion 76 of the cover 70.

As just described, according to this embodiment, erroneous assembly of the cover 70 with the housing 20 can be prevented. Particularly, the front ends (forward facing end surfaces 91) of the rib 87 butt against the rear ends (rearward facing end surfaces 33) of the respective protrusions 22 in the thickness range. Thus, the rib 87 can avoid interference with the respective rubber plugs 13 and the respective wires 12 exposed from the rear ends of the respective protrusions 22.

On the other hand, if it is desired to draw out the respective wires 12 rearward from the other widthwise end side of the housing 20, opposite to a mode shown in FIG. 2, a cover not including the rib 87 may be prepared instead of the above cover 70. If the cover does not include the rib 87, the first and third retaining portions 81, 83 are insertable into the passages 29 through the receiving ports 31 from the state shown in FIG. 5, and the cover can be assembled with the housing 20. The cover in this case may include a cover-side lock portion on each of both upper and lower surfaces.

As just described, the connector 10 of this embodiment is compatible with both the cover required to have reversibility to be useable in an inverted posture and the cover 70 required to have certain assemblability to prevent erroneous assembly.

As described above, according to this embodiment, the cover 70 is properly assembled with the housing 20 with the engaged portions 81 to 85 of the cover 70 engaged with the respective engaging portions 27 of the housing 20 and the respective protrusions 22 located in the space portion 77. In contrast, if the cover 70 is in the posture opposite to the proper one when being assembled, the rib 87 interferes with the respective protrusions 22 and the assembling operation of the cover 70 is restricted. In this way, erroneous assembly of the cover 70 with the housing 20 can be prevented.

Further, since the respective protrusions 22 can have a function of preventing erroneous assembly of the cover 70 and a function of forming some of the cavities 21, the complication of the structure of the housing 20 can be avoided. Further, the rib 87 can have the function of preventing erroneous assembly of the cover 70 and a function of reinforcing the cover 70, the complication of the structure of the cover 70 can be avoided. Particularly, since the rib 87 is provided between the widthwise central part of the cover 70 and the end wall 74 on the inner surfaces of the respective facing walls 71A, 71B and arranged closer to the end wall 74 than the second rib 88, the opening deformation of the respective facing walls 71A, 71B can be effectively suppressed.

Further, since the front ends of the rib 87 interfere with the rear ends of the respective protrusions 22 in the thickness range, the damage of the respective wires 12 and the rubber plugs 13 exposed from the respective protrusions 22 by the rib 87 can be suppressed.

Furthermore, since the front ends of the rib 87 are arranged behind the front ends of the respective facing walls 71A, 71B, the respective protrusions 22 enter between the respective facing walls 71A, 71B before the rib 87 interferes with the respective protrusions 22, and can reach positions where the protrusions 22 can interfere with the rib 87. As a result, the rib 87 can reliably interfere with the respective protrusions 22 and reliability in preventing erroneous assembly of the cover 70 can be enhanced.

OTHER EMBODIMENTS OF PRESENT DISCLOSURE

The embodiment disclosed this time should be considered illustrative in all aspects, rather than restrictive.

Although the respective engaging portions are formed to have the same shape point-symmetrical in the back view of the housing in the case of the above embodiment, the respective engaging portions only have to be arranged at positions point-symmetrical in the back view and need not have the same shape as another embodiment.

Although the rib is formed to extend from the respective facing walls to the back wall on the inner surface of the cover in the case of the above embodiment, a rib may be formed to extend only on the inner surface of at least one of the respective facing walls as another embodiment.

Although the interfering portion is constituted by the rib in the case of the above embodiment, an interfering portion may be constituted by a simple convex or concave step surface as another embodiment.

Although the engaged portions are constituted by the retaining portions (first, second, third and fourth retaining portions) and the locking portions in the case of the above embodiment, engaging portions may be constituted by either retaining portions or locking portions as another embodiment. Further, the engaged portion also needs not be provided at each of the positions corresponding to the plurality of engaged portions.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing; and a cover assembled with the housing and configured to cover a rear surface of the housing, wherein:

the housing includes a plurality of engaging portions arranged at positions point-symmetrical in a back view on a peripheral edge part of the rear surface and a protrusion arranged to project rearward from the rear surface, and the cover includes:

a plurality of engaged portions engaged with and held by the plurality of engaging portions;

a space portion, the protrusion of the housing being located in the space portion of the cover with the cover properly assembled with the housing; and an interfering portion provided on an inner surface of the cover and configured to interfere with the protrusion of the housing when the cover is assembled with the housing in a direction opposite to a direction in which the cover is properly assembled with the housing the housing.

2. The connector of claim 1, wherein:

the housing includes a cavity capable of accommodating a terminal fitting, and the protrusion has a tubular shape to surround the cavity.

3. The connector of claim 2, wherein:

the cover is cap-shaped and includes a pair of facing walls facing each other in a height direction and a back wall configured to close a space between rear end parts of the pair of facing walls, the pair of facing walls include a rib extending in a front-rear direction on an inner surface of each of the pair of facing walls, and the interfering portion is constituted by the rib.

4. The connector of claim 3, wherein:

the cover includes an opening open laterally on one end part in a width direction of the cover and an end wall configured to close another end part in the width direction, and the rib is provided between a central part in the width direction and the end wall of the cover on the inner surface of each of the pair of facing walls.

5. The connector of claim 3, wherein a projection dimension of the rib from the inner surface of each of the pair of facing walls is smaller than a radial thickness of the protrusion having the tubular shape.

6. The connector of claim 3, wherein a front end of the rib is arranged behind a front end of each of the pair of facing walls.

7. The connector of claim 1, wherein the interfering portion continuously extends on the inner surface of the cover in a rib shape.

8. The connector of claim 3, wherein the interfering portion extends along the inner surface of each of the pair of facing walls and the back wall of the cover.

9. The connector of claim 1, wherein the protrusion is arranged to face a front of the interfering portion.

* * * * *